US009464805B2

(12) United States Patent
Smelcer

(10) Patent No.: US 9,464,805 B2
(45) Date of Patent: Oct. 11, 2016

(54) MODULATING BURNER

(71) Applicant: A. O. Smith Corporation, Milwaukee, WI (US)

(72) Inventor: Jim C. Smelcer, Hermitage, TN (US)

(73) Assignee: Lochinvar, LLC, Labanon, TN (US)

( * ) Notice: Subject to any disclaimer, the term of this patent is extended or adjusted under 35 U.S.C. 154(b) by 676 days.

(21) Appl. No.: 13/742,460

(22) Filed: Jan. 16, 2013

(65) Prior Publication Data

US 2014/0199643 A1 Jul. 17, 2014

(51) Int. Cl.

| | |
|---|---|
| ***F23D 14/02*** | (2006.01) |
| ***F23N 3/00*** | (2006.01) |
| ***F24H 1/28*** | (2006.01) |
| *F24D 11/00* | (2006.01) |

(52) U.S. Cl.

CPC ..... *F23N 3/00* (2013.01); *F24H 1/287* (2013.01); *F23N 2033/08* (2013.01); *F23N 2035/06* (2013.01); *F23N 2037/10* (2013.01); *F24D 11/002* (2013.01)

(58) Field of Classification Search

CPC ..... F23D 14/02; F23D 14/34; F23D 14/70; F23D 2900/00003; F23N 2025/04; F24H 1/287

USPC ..... 431/12, 38

See application file for complete search history.

(56) References Cited

U.S. PATENT DOCUMENTS

| | | | |
|---|---|---|---|
| 108,050 | A | 10/1870 | Raisbeck et al. |
| D14,883 | S | 3/1884 | Arci et al. |
| 469,731 | A | 3/1892 | Althouse |
| 514,338 | A | 2/1894 | Row |
| 629,245 | A | 7/1899 | Frank |
| 691,978 | A | 1/1902 | Smith et al. |
| 770,599 | A | 9/1904 | Monteagle |
| 811,016 | A | 1/1906 | Whyte et al. |
| 910,192 | A | 1/1909 | Grouvelle et al. |
| 951,215 | A | 3/1910 | Millan |
| 1,391,871 | A | 9/1921 | Volk |
| 1,448,075 | A | 3/1923 | Melville |
| 1,780,110 | A | 10/1930 | Bliss |

(Continued)

FOREIGN PATENT DOCUMENTS

| | | | |
|---|---|---|---|
| CA | 1102901 A1 | 6/1981 | |
| DE | 29606020 U1 * | 6/1996 | ..... F23D 14/46 |

(Continued)

OTHER PUBLICATIONS

Canadian Office Action in corresponding Canadian Patent Application No. 2,838,380 dated Mar. 12, 2015, 5 pages.

(Continued)

*Primary Examiner* — Jorge Pereiro

(74) *Attorney, Agent, or Firm* — Lucian Wayne Beavers; Patterson Intellectual Property Law PC

(57) ABSTRACT

A modulating burner apparatus includes a variable speed blower feeding a multi-chamber burner having first and second burner chambers. A manifold system communicates the blower with the burner, and a flow control valve member is located between the blower and the second chamber of the burner. The flow control valve is configured to provide fuel and air mixture from the blower to only the first burner chamber at lower blower speeds of the blower and to both the first and second burner chambers at higher blower speeds of the blower.

40 Claims, 9 Drawing Sheets

(56) References Cited

U.S. PATENT DOCUMENTS 1,780,319 A 11/1930 Sonneborn
1,881,610 A 10/1932 Hyde
1,951,063 A 3/1934 Reimann et al.
1,979,859 A 11/1934 Brown
1,991,788 A 2/1935 Cartier
2,067,446 A 1/1937 Good
2,162,620 A 6/1939 Larsen
2,205,893 A 6/1940 Unger
2,335,687 A 11/1943 Modine
2,365,688 A 12/1944 Dewey
2,477,732 A * 8/1949 Gardner ..... F02M 29/04 123/184.39
2,506,120 A 5/1950 Turner et al.
2,560,862 A * 7/1951 Harrison ..... 239/553.5
2,598,346 A 5/1952 Burke et al.
2,621,721 A 12/1952 Manteria
3,002,519 A 10/1961 Wright et al.
3,004,330 A 10/1961 Wilkins
3,090,558 A 5/1963 Vaughn
3,177,936 A 4/1965 Walter
3,334,820 A * 8/1967 Flynn ..... F23D 14/10 159/43.1
3,486,834 A 12/1969 Frey et al.
3,516,773 A 6/1970 Rosenberg et al.
3,698,429 A 10/1972 Lowe et al.
3,724,523 A 4/1973 Mattern
3,733,164 A * 5/1973 Westlake ..... F23D 91/02 431/328
3,831,582 A 8/1974 Mahoney
3,875,997 A 4/1975 Newson et al.
3,947,233 A * 3/1976 Sundberg ..... F23D 14/02 431/328
3,964,873 A 6/1976 Aramaki et al.
4,014,962 A 3/1977 del Notario
4,017,024 A 4/1977 Grostick et al.
4,039,123 A 8/1977 Frankel
4,095,929 A 6/1978 McCartney
4,190,105 A 2/1980 Dankowski
4,204,833 A 5/1980 Kmetz et al.
4,206,806 A 6/1980 Togashi
4,250,145 A * 2/1981 Pobst, Jr. ..... C09C 1/50 422/151
4,267,965 A 5/1981 Everett
4,270,470 A 6/1981 Barnett et al.
4,271,789 A 6/1981 Black
4,316,881 A * 2/1982 Pobst, Jr. ..... C09C 1/50 423/450
4,321,030 A 3/1982 Matthews
4,393,926 A 7/1983 Appel
4,434,112 A 2/1984 Pollock
4,462,342 A 7/1984 Welden
4,466,479 A 8/1984 MacLean
4,511,327 A 4/1985 Ogino et al.
4,548,138 A 10/1985 Korenberg
4,599,066 A 7/1986 Granberg
4,632,090 A 12/1986 York
4,678,116 A 7/1987 Krishnakumar et al.
4,688,521 A 8/1987 Korenberg
4,723,513 A 2/1988 Vallett et al.
4,725,224 A 2/1988 Kanter
4,766,883 A * 8/1988 Cameron et al. ..... 122/14.21
4,778,378 A 10/1988 Dolnick et al.
4,793,798 A 12/1988 Sabin
4,793,800 A 12/1988 Vallett et al.
4,852,524 A 8/1989 Cohen
4,959,009 A 9/1990 Hemsath
5,022,352 A * 6/1991 Osborne et al. ..... 122/17.2
5,024,379 A 6/1991 Dempsey
5,080,577 A 1/1992 Bell et al.
5,085,579 A * 2/1992 Moore et al. ..... 431/326
5,088,916 A * 2/1992 Furuhashi et al. ..... 431/90
5,099,576 A 3/1992 Shinmura
5,131,836 A 7/1992 Coppin
5,190,454 A 3/1993 Murray et al.
5,251,693 A 10/1993 Zifferer
5,311,661 A 5/1994 Zifferer
5,357,907 A * 10/1994 Moore et al. ..... 122/14.22
5,393,221 A 2/1995 McNally
5,409,057 A 4/1995 Zifferer
5,443,040 A 8/1995 Kaji et al.
5,458,484 A * 10/1995 Ripka ..... F23D 14/58 126/109
5,470,224 A 11/1995 Bortz
5,488,942 A 2/1996 Maughan
5,551,504 A 9/1996 Zifferer
5,579,832 A 12/1996 Le Gauyer
5,590,711 A 1/1997 Ishida et al.
5,644,842 A 7/1997 Coleman
5,685,707 A * 11/1997 Ramsdell et al. ..... 431/90
5,839,505 A 11/1998 Ludwig et al.
5,881,681 A 3/1999 Stuart
5,915,952 A 6/1999 Manning et al.
5,915,960 A 6/1999 Check et al.
5,960,870 A 10/1999 Takahashi et al.
5,989,011 A 11/1999 Caruso et al.
5,989,020 A 11/1999 Glass et al.
6,082,993 A 7/2000 O'Leary et al.
6,129,545 A * 10/2000 Kahlke ..... F23D 14/02 126/39 J
6,179,212 B1 * 1/2001 Banko ..... 236/1 E
6,206,687 B1 3/2001 Redington
6,269,755 B1 8/2001 Boswell et al.
6,273,141 B1 8/2001 DeSellem
6,283,159 B1 9/2001 Tada
6,312,250 B1 * 11/2001 Neville ..... F23D 14/02 239/415
6,363,868 B1 4/2002 Boswell et al.
6,378,516 B1 4/2002 Blount
6,428,312 B1 8/2002 Smelcer et al.
6,435,862 B1 8/2002 Fioriti et al.
6,485,289 B1 11/2002 Kelly et al.
6,488,079 B2 12/2002 Zifferer
6,553,946 B1 4/2003 Abraham et al.
6,565,361 B2 5/2003 Jones et al.
6,619,951 B2 9/2003 Bodnar et al.
6,629,523 B2 10/2003 Saltzman et al.
6,659,026 B1 12/2003 Hendricks et al.
6,685,462 B2 2/2004 Jones et al.
6,694,926 B2 2/2004 Baese et al.
6,780,008 B2 8/2004 Koch et al.
6,923,035 B2 8/2005 Zifferer et al.
6,941,754 B2 9/2005 Aldridge et al.
7,044,123 B2 5/2006 Rigamonti
7,188,481 B2 3/2007 DeYoe et al.
7,703,705 B2 4/2010 Ganzer
7,748,684 B2 7/2010 Ito et al.
8,100,381 B2 1/2012 Roschke et al.
8,286,594 B2 10/2012 Smelcer
8,882,467 B2 * 11/2014 Kwok ..... F04D 29/281 416/186 R
2005/0106517 A1 * 5/2005 Okada et al. ..... 431/9
2006/0035189 A1 * 2/2006 Berstecher ..... F23C 99/006 431/329
2006/0194160 A1 8/2006 Kokuo et al.
2007/0044787 A1 3/2007 Brice
2007/0209788 A1 9/2007 Jing et al.
2007/0215225 A1 9/2007 Koch et al.
2008/0076079 A1 3/2008 Eggebrecht et al.
2008/0105176 A1 5/2008 Chang et al.
2008/0216771 A1 9/2008 Paine
2008/0216772 A1 * 9/2008 Gordon ..... F24H 1/205 122/18.3
2009/0165733 A1 * 7/2009 Ferguson ..... F23C 5/08 122/18.3
2009/0191493 A1 7/2009 Guzorek
2010/0047728 A1 * 2/2010 Kim ..... F23D 14/34 431/89
2010/0095905 A1 4/2010 Smelcer
2010/0116225 A1 5/2010 Smelcer
2011/0083593 A1 4/2011 Hunter et al.
2011/0114034 A1 5/2011 Aycock
2011/0139045 A1 * 6/2011 Zatti ..... F23D 14/60 110/188
2011/0146594 A1 6/2011 Smelcer

(56) References Cited

U.S. PATENT DOCUMENTS

| | | | | |
|---|---|---|---|---|
| 2012/0021365 | A1* | 1/2012 | Werle | F23D 14/34 431/6 |
| 2012/0111434 | A1 | 5/2012 | Cadeau et al. | |
| 2012/0132836 | A1 | 5/2012 | Cadeau et al. | |
| 2012/0153200 | A1 | 6/2012 | Turrin et al. | |
| 2012/0216792 | A1 | 8/2012 | Noman | |
| 2012/0328969 | A1* | 12/2012 | DeWald | F04D 25/166 429/455 |
| 2013/0042822 | A1* | 2/2013 | Fioriti | F23N 5/006 122/14.21 |
| 2013/0284115 | A1 | 10/2013 | Kim et al. | |
| 2013/0294192 | A1* | 11/2013 | Son | 366/182.4 |

FOREIGN PATENT DOCUMENTS

| | | | | | |
|---|---|---|---|---|---|
| DE | 29611596 | U1 | * | 9/1996 | |
| DE | 19835692 | C2 | * | 10/2001 | F23D 14/46 |
| DE | 102010054807 | A1 | * | 6/2012 | F23D 23/00 |
| EP | 0781964 | A1 | * | 7/1997 | |
| JP | 57207719 | | | 12/1982 | |
| JP | 58052905 | | | 3/1983 | |
| JP | 61079914 | A | | 4/1986 | |
| JP | 1314809 | | | 12/1989 | |
| JP | 3263508 | A | | 11/1991 | |
| JP | 07190484 | A | | 7/1995 | |
| JP | 2002174420 | A | | 6/2002 | |
| JP | 2004019974 | A | * | 1/2004 | |
| JP | 2006038418 | A | | 2/2006 | |
| SE | 518478 | C2 | | 10/2002 | |
| WO | 2004097274 | A1 | | 11/2004 | |
| WO | 2011009793 | A1 | | 1/2011 | |
| WO | 2012079167 | A1 | | 6/2012 | |

OTHER PUBLICATIONS

Exhibit A: Aerco Benchmark literature. (Undated but admitted to be prior art.).

Exhibit B: Lochinvar Copper-Fin literature. (Undated but admitted to be prior art.).

"Notification of Transmittal of the International Search Report and the Written Opinion of the International Searching Authority, or the Declaration" mailing date Dec. 16, 2009. (not prior art.).

Co-pending U.S. Appl. No. 12/691,108, filed Jan. 21, 2010. (not prior art.).

Co-pending U.S. Appl. No. 12/978,681, filed Dec. 27, 2010. (not prior art.).

Co-pending U.S. Appl. No. 13/614,450, filed Sep. 13, 2012. (not prior art.).

Website printout, Product News: HVAC re "BLDC Combustion Blowers", Oct. 2011, 2 pp.

Sketches of BTH250 burner having fixed circular target disk, 2 pp. (undated but admitted to be prior art).

Office Action of Nov. 10, 2015 in corresponding Canada Patent Application Serial No. 2,838,380, 6 pp. (not prior art).

* cited by examiner

MODULATING BURNER

BACKGROUND OF THE INVENTION

1. Field of the Invention

The present invention relates generally to a modulating burner apparatus, and more specifically, but not by way of limitation, to a gas fired appliance incorporating a modulating burner.

2. Description of the Prior Art

Most conventional gas fired burner technologies utilize a single chamber burner designed to operate at a fixed flow rate of combustion air and fuel gas to the burner. Such technologies require that the burner cycles on and off in response to a control system which determines when the demand for energy has been met, and cycles back on at a predetermined setpoint when there is a demand for more energy. One example of such a typical prior art system which is presently being marketed by the assignee of the present invention is that shown in U.S. Pat. Nos. 4,723,513 and 4,793,800 to Vallett et al., the details of which are incorporated herein by reference.

The assignee of the present invention has also developed a continuously variable modulating burner apparatus for a water heating appliance with variable air and fuel input, as shown in U.S. Pat. No. 6,694,926 to Baese et al. In the Baese apparatus combustion air and fuel are introduced separately in controlled amounts upstream of a blower and are then premixed and delivered into a single chamber burner at a controlled blower flow rate within a prescribed blower flow rate range. This allows the heat input of the water heating appliance to be continuously varied within a substantial flow range having a burner turndown ratio of as much as 4:1. It should be understood by those skilled in the art that a 4:1 burner turndown capability will result in the appliance remaining in operation for longer periods of time during a typical seasonal demand than an appliance with less than 4:1 burner turndown ratio, or with appliances with no turndown ratio at all.

More recently, the assignee of the present invention has developed a water heating appliance including a dual-chamber burner, with dual blower assemblies providing fuel and air mixture to the chambers of the burner, as shown in U.S. Pat. No. 8,286,594 to Smelcer, the details of which are incorporated herein by reference. Through the use of the dual blower assemblies this system is capable of achieving turndown ratios of as much as 25:1 or greater. It should be understood by those skilled in the art that a 25:1 burner turndown capability will result in the appliance remaining in operation for longer periods of time during a typical seasonal demand than an appliance with less than 25:1 burner turndown ratio, or with appliances with no burner turndown ratio at all.

There is a continuing need for improvements in modulating burners which can provide modulation of heat input over a wider range of heat demands. Particularly there is a need for systems providing high turndown ratios with reduced mechanical complexity at significantly reduced cost as compared to known practices today.

SUMMARY OF THE INVENTION

In one embodiment a modulating burner apparatus includes one and only one source of pressurized pre-mixed fuel and air mixture, the source including at least one variable speed blower. The apparatus includes a multi-chamber burner configured to burn the pre-mixed fuel and air mixture, the burner including at least a first burner chamber and a second burner chamber. The apparatus further includes a flow controller configured to provide fuel and air mixture from the one and only one source to only the first burner chamber at lower blower speeds of the blower and to both the first and second burner chambers at higher blower speeds of the blower.

In another embodiment a modulating burner apparatus includes a variable speed blower, the blower including a blower outlet, and a multi-chamber burner configured to burn a pre-mixed fuel and air mixture, the burner including at least a first burner chamber and a second burner chamber. The second burner chamber is located adjacent the first burner chamber so that the second burner chamber can be ignited by the first burner chamber. A supply manifold communicates the blower with the burner, the supply manifold including a first passage portion communicated with the blower outlet, a second passage portion communicating the first passage portion with the first burner chamber, and a third passage portion communicating the first passage portion with the second burner chamber. A valve is located between the first passage portion and the third passage portion, the valve being configured such that as the blower speed increases from a lower speed range through a transition speed range to a higher speed range, the valve moves from a closed position when blower-speed is in the lower speed range to an open position when blower speed is in the higher speed range.

In another embodiment an apparatus for heating water includes a water conduit having an inlet and an outlet, a heat exchanger having a water side defining a portion of the water conduit, and a pre-mix burner configured to burn a pre-mixed fuel-air mixture. The burner is operatively associated with the heat exchanger to heat water in the water side of the heat exchanger. The burner includes a first plenum communicated with a first foraminous burner surface, and a second plenum communicated with a second foraminous burner surface, the first and second foraminous burner surfaces being sufficiently close to each other so that flame from the first foraminous burner surface will ignite fuel-air mixture exiting the second foraminous burner surface. A variable flow blower has a blower outlet communicated with the first and second plenums. A damper is located between the second plenum and the blower outlet. A biasing spring biases the damper toward a closed position, the damper being movable toward an open position when fluid pressure from the blower acting on the damper overcomes the biasing spring.

In another embodiment, a method of modulating energy input to a multi-stage burner includes steps of:

(a) modulating blower speed of a variable speed blower within a lower speed range to modulate energy input to a first stage of the burner within a lower burner input range while a second stage of the burner is inoperative;

(b) opening a valve to allow flow of fuel and air mixture to the second stage of the burner; and (c) modulating blower speed of the variable speed blower within a higher speed range to modulate energy input to the combined first and second stages of the burner within a higher burner input range.

In any of the above embodiments, the blower may include one and only one blower.

In any of the above embodiments the control valve may include a spring pre-load adjuster configured to adjust an opening force required to move the valve member from the closed position.

In any of the above embodiments the valve member may include a disc shaped valve member operatively associated with a coil compression biasing spring.

In any of the above embodiments the blower may be a centrifugal blower having a blower output versus blower speed curve for a given flow restriction downstream of the blower, and the first burner chamber may define a higher flow restriction and the first and second burner chambers together may define a lower flow restriction, so that at the lower blower speeds when fuel and air mixture is provided to only the first burner chamber the blower output follows a first curve corresponding to the higher flow restriction, and at the higher blower speeds when fuel and air mixture is provided to both the first and second burner chambers the blower output follows a second curve corresponding to the lower flow restriction.

In any of the above embodiments an energy input to the burner can be continuously modulated over a lower input range modulation curve corresponding to operation of only the first burner chamber, and the energy input to the burner can be continuously modulated over a higher input range modulation curve corresponding to operation of both the first and second burner chambers together, there being an intermediate modulation curve between the lower and higher input range modulation curves, the intermediate modulation curve being steeper than the lower and higher input range modulation curves.

In any of the above embodiments the apparatus may have an overall modulation range of at least 16 to 1, and more preferably at least 25 to 1.

An object of the invention is to provide a high turndown burner apparatus having reduced complexity and reduced cost.

Other and further objects, features and advantages of the present invention will be readily apparent to those skilled in the art upon a reading of the following disclosure when taken in conjunction with the accompanying drawings.

DETAILED DESCRIPTION OF THE INVENTION

Figure 1:
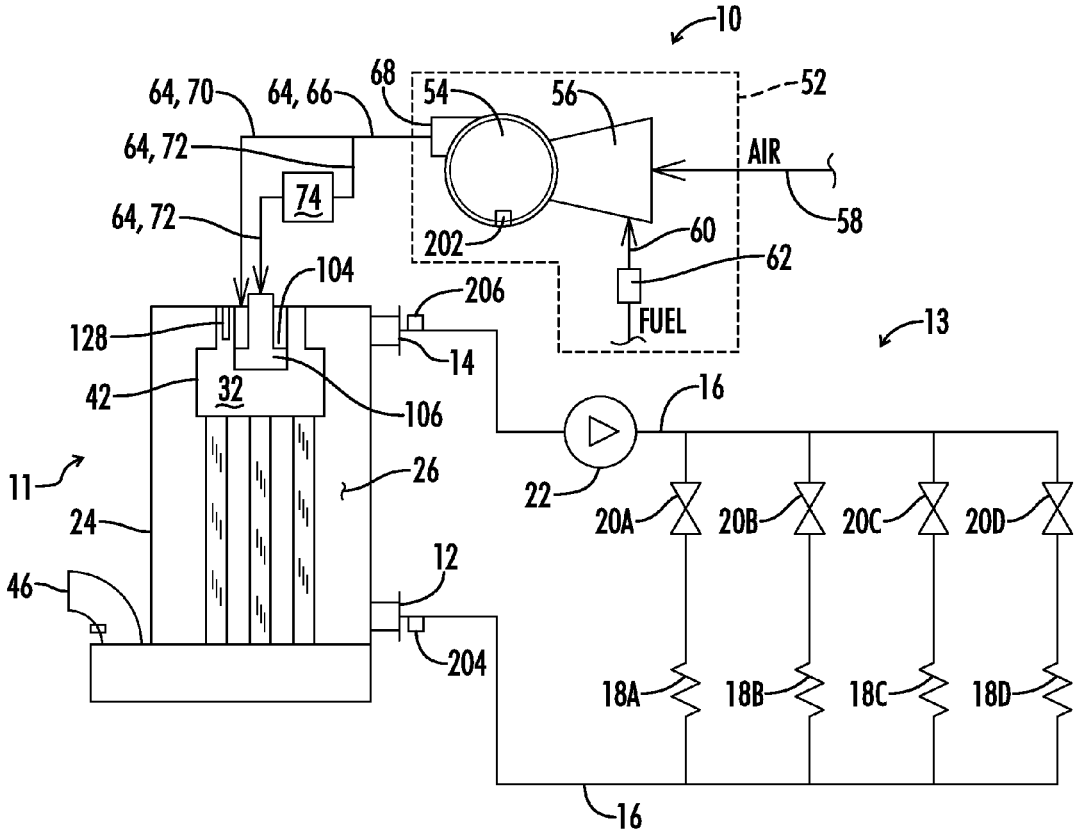
FIG. 1 is a schematic illustration of a modulating burner apparatus having a dual chamber burner fed by a single variable speed blower with a flow control valve controlling flow to the burner chambers. The burner apparatus is shown as used in a water heating appliance.

Referring now to the drawings, and particularly to FIG. 1, a modulating burner apparatus is shown and generally designated by the numeral 10. The apparatus 10 is shown as used in a water heating apparatus or appliance 11 as part of a system 13 for heating water, but it will be understood that in its broadest application the modulating burner apparatus 10 may be used in any system in which it is desired to provide a modulating burner having a high turndown ratio. For example, the modulating burner apparatus may be used as a burner for an industrial furnace or the like.

The modulating burner apparatus 10 includes a source 52 of pressurized pre-mixed fuel and air mixture including a variable speed blower 54, a multi-stage burner 42 configured to burn the pre-mixed fuel and air mixture, and a flow controller or flow control valve 74 configured to provide fuel and air mixture to only a first burner chamber at lower blower speeds and to both the first and a second burner chamber at higher blower speeds.

The modulating burner apparatus disclosed herein makes use of a dual chamber burner similar to that disclosed in U.S. Pat. No. 8,286,574 discussed above, but with a greatly simplified blower and control system. The modulating burner apparatus 10 uses one and only one source of pressurized pre-mixed fuel and air mixture, as opposed to the use of separate low range and high range blower assemblies as was shown in U.S. Pat. No. 8,286,574. That one and only one source of pressurized pre-mixed fuel and air mixture is preferably provided by one and only one variable speed blower, although as is shown below multiple blowers can be combined to provide one common source of pressurized pre-mixed fuel and air mixture.

As used herein, the terms water heating apparatus or water heating appliance or water heating system or water heater apparatus or water heater all are used interchangeably and all refer to an apparatus for heating water, including both boilers and water heaters as those terms are commonly used in the industry. Such apparatus are used in a wide variety of commercial and residential applications including potable water systems, space heating systems, pool heaters, process water heaters, and the like. Also, the water being heated can include various additives such as antifreeze or the like.

The water heating apparatus 11 illustrated in FIG. 1 is a fire tube heater. A fire tube heater is one in which the hot combustion gases from the burner flow through the interior of a plurality of tubes. Water which is to be heated flows around the exterior of the tubes. The operating principles of the modulating burner apparatus 10 are equally applicable, however, to use in water heaters having the water flowing through the interior of the tubes and having the hot combustion gases on the exterior of the tubes, such as for example the design shown in U.S. Pat. No. 6,694,926 to Baese et al. discussed above.

The water heating apparatus 11 shown in the system 13 of FIG. 1 is connected to a heat demand load in a manner sometimes referred to as full flow heating wherein a water inlet 12 and water outlet 14 of the heating apparatus 11 are directly connected to a flow loop 16 which carries the heated water to a plurality of loads 18A, 18B, 18C and 18D. The loads 18A-18D may, for example, represent the various heating loads of heat radiators contained in different areas of a building. Heat to a given area of the building may be turned on or off by controlling zone valves 20A-20D. Thus as a radiator is turned on and off or as the desired heat is regulated in various zones of the building, the water flow permitted to that zone by zone valve 20 will vary, thus providing a varying water flow through the flow loop 16 and a varying heat load on the water heating apparatus 11 and its modulating burner apparatus 10. A supply pump 22 in the flow loop 16 circulates the water through the system 13. The operating principles of the water heating apparatus 11 and its modulating burner apparatus 10 are, however, also applicable to heating apparatus connected to other types of water supply systems, such as for example a system using a primary flow loop for the heat loads, with the water heating apparatus being in a secondary flow loop so that not all of the water circulating through the system necessarily flows back through the water heater. An example of such a primary and secondary flow loop system is seen in U.S. Pat. No. 7,506,617 of Paine et al., entitled "Control System for Modulating Water Heater", and assigned to the assignee of the present invention, the details of which are incorporated herein by reference.

Figure 2:
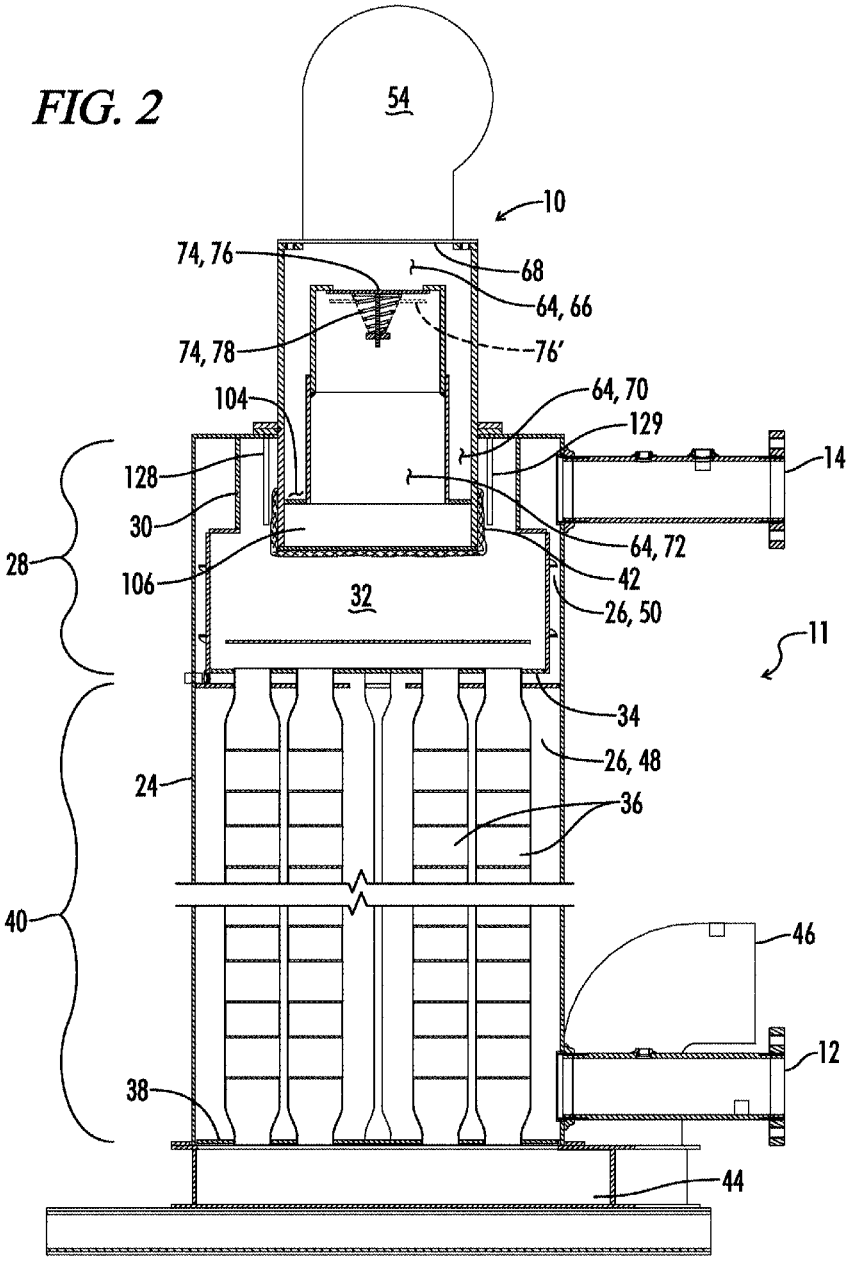
FIG. 2 is schematic elevation cross-section view of the modulating burner apparatus and water heating appliance of FIG. 1.

As best shown in FIG. 2, the water heating apparatus 11 includes an outer jacket 24. The water inlet 12 and water outlet 14 communicate through the jacket 24 with a water chamber 26 or water side 26 of the heat exchanger. In an upper or primary heat exchanger portion 28, an inner heat exchange wall or inner jacket 30 has a combustion chamber or combustion zone 32 defined therein. The lower end of the combustion chamber 32 is closed by an upper tube sheet 34. A plurality of fire tubes 36 have their upper ends connected to upper tube sheet 34 and their lower ends connected to a lower tube sheet 38. The fire tubes extend through a secondary heat exchanger portion 40 of the water heating apparatus 11.

A burner assembly or burner apparatus 42 is located within the combustion chamber 32. The burner assembly 42 burns pre-mixed fuel and air within the combustion chamber 32. The hot gases from the combustion chamber 32 flow down through the fire tubes 36 to an exhaust collector 44 and out an exhaust flue 46.

Water from flow loop 16 to be heated flows in the water inlet 12, then around the exterior of the fire tubes 36 and up through a secondary heat exchanger portion 48 of water side 26, and continues up through a primary heat exchanger portion 50 of water side 26, and then out through water outlet 14. It will be appreciated that the interior of the water heating apparatus 11 includes various baffles for directing the water flow in such a manner that it generally uniformly flows around all of the fire tubes 36 and through the water chamber 50 of primary heat exchanger 28 between the outer jacket 24 and inner jacket 30. As the water flows upward around the fire tubes 36 of the secondary heat exchanger 40 the water is heated by heat transfer from the hot combustion gases inside of the fire tubes 36 through the walls of the fire tubes 36 into the water flowing around the fire tubes 36. As the heated water continues to flow upward through the water side 50 of primary heat exchanger 28 additional heat is transferred from the combustion chamber 32 through the inner jacket 30 into the water contained in water side 50.

Figure 10:
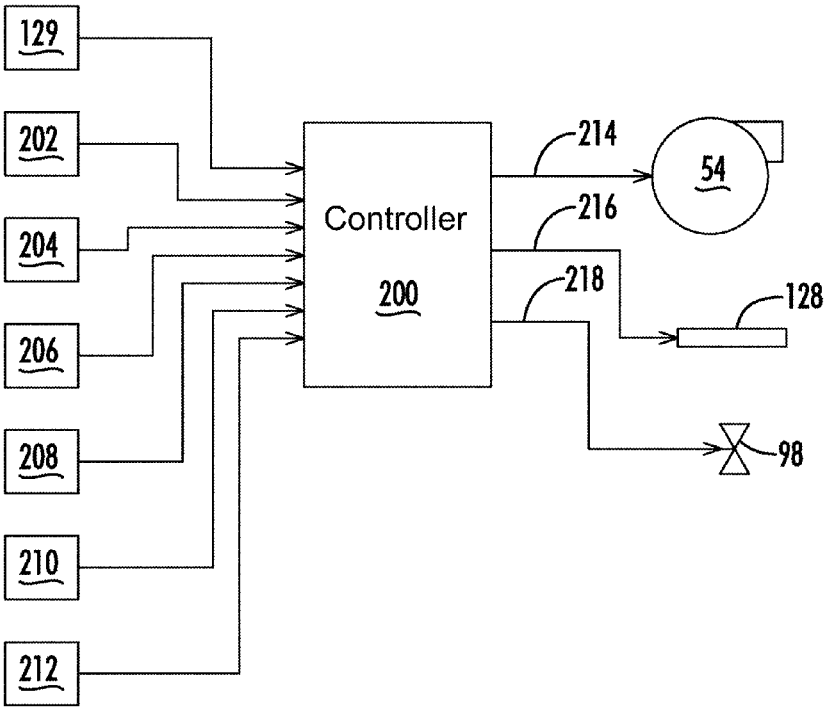
FIG. 10 is a schematic representation of an electronic control system for the water heating system of FIG. 1.

FIG. 10 schematically illustrates a control system that may be included in the water heating apparatus 11. The control system includes a controller 200. The controller receives various inputs from sensors 202-210. Sensor 202 may be a blower speed sensor associated with blower 54. Sensor 204 may be an inlet water temperature sensor. Sensor 206 may be an outlet water temperature sensor. Sensor 208 may be a flame detector associated with burner 42. Sensor 210 may be a room temperature sensor. Input 212 may be a set point input, for example from a room temperature thermostat, or for a thermostat of a water supply storage tank associated with the water heater.

The controller 200 also provides output signals to various components, such as a blower speed control signal over line 214 to blower 54, an ignition signal over line 216 to direct spark ignition element 128, and a control signal over line 218 to electric actuator 98 of the positive control valve 74B of FIG. 8, all of which are discussed in further detail below.

The Blower Assembly

Referring again to FIG. 1, a blower assembly 52 is connected to the burner apparatus 42 for supplying pre-mixed fuel and air to the burner assembly 42. The blower assembly 52 is a variable flow pre-mix blower assembly.

The blower assembly 52 includes a variable flow blower 54 driven by a variable frequency drive motor. A venturi 56 is provided for mixing combustion air and fuel gas. An air supply duct 58 provides combustion air to the venturi 56. A gas supply line 60 provides fuel gas to the venturi 56. A gas control valve 62 is disposed in supply line 60 for regulating the amount of gas entering the venturi 56. The gas control valve 62 includes an integral shutoff valve. In some embodiments the gas control valve and the venturi may be combined into a single integral unit. The gas control valve is preferably a zero governor or negative regulation type gas valve for providing fuel gas to the venturi 56 at a variable gas rate which is proportional to the negative air pressure within the venturi caused by the speed of the blower, hence varying the flow rate entering the venturi 56, in order to maintain a predetermined air to fuel ratio over the flow rate range within which the blower 54 operates.

The venturi 56 may be more generally described as a mixing chamber 56 upstream of the blower 54, the mixing chamber 56 being configured to at least partially pre-mix the fuel and air mixture prior to the fuel and air mixture entering an inlet of the blower 54. It is noted, however, that the blower assembly 52 could alternatively be of a construction wherein the fuel gas is added to the air at the outlet or shortly downstream of the outlet of the blower 54.

The blower assembly 52 as schematically illustrated in FIG. 1 may be described as one and only one source 52 of pressurized pre-mixed fuel and air mixture, which source includes at least one variable speed blower 54.

Figure 3:
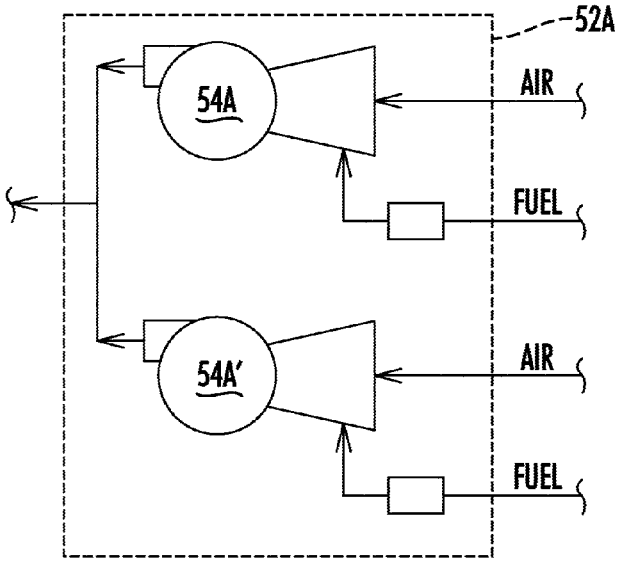
FIG. 3 is a schematic illustration of an alternative source of pressurized fuel and air mixture using two variable speed blowers in parallel.

Alternatively, as shown in FIG. 3, the one and only one source 52 may be replaced by alternative source 52A in which the blower assembly is made up of a plurality of smaller blowers 54A and 54A', connected in parallel to provide the desired blower output. Such an arrangement of smaller blowers manifolded together may in some situations be desirable from a practical standpoint due to the availability and cost of the smaller variable speed blowers, while still providing essentially the same reduced complexity as shown in the system of FIG. 1.

Figure 4:
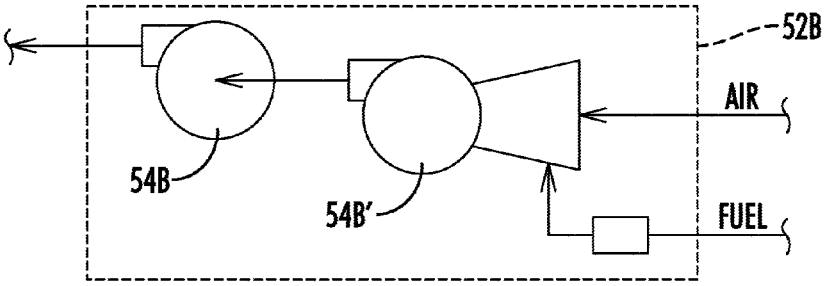
FIG. 4 is a schematic illustration of an alternative source of pressurized fuel and air mixture using two variable speed blowers in series.

In still another alternative as shown in FIG. 4, the one and only one source of pressurized pre-mixed fuel and air mixture 52B can be provided by a plurality of smaller blowers 54B and 54B' connected in series to provide the desired blower output.

As schematically illustrated in FIGS. 1 and 2, the modulating burner apparatus 10 includes a supply manifold 64 which communicates the blower assembly 52 with the burner assembly 42. The supply manifold 64 includes a first passage portion 66 communicated with a blower outlet 68, a second passage portion 70 communicating the first passage portion 66 with a first burner chamber 104 of burner assembly 42 as further described below, and a third passage portion 72 communicating the first passage portion 66 with a second burner chamber 106 of the burner assembly 42.

The Flow Control Valve Assembly

The modulating burner apparatus 10 includes a flow controller or flow control valve schematically indicated as 74 in FIG. 1. The valve 74 is located between the first and third passage portions 66 and 72. The valve 74 is configured such that as the blower speed of blower 54 increases from a lower speed range through a transition speed range to a higher speed range, the valve 74 moves from a closed position when the blower is in the lower speed range to an open position when the blower 54 is in the higher speed range. The valve 74 is configured to provide fuel and air mixture from the one and only one source 52 to the first burner chamber 104 at lower blower speeds of the blower 54 and to both the first and second burner chambers 104 and 106 at higher blower speeds of the blower 54.

Figure 6:
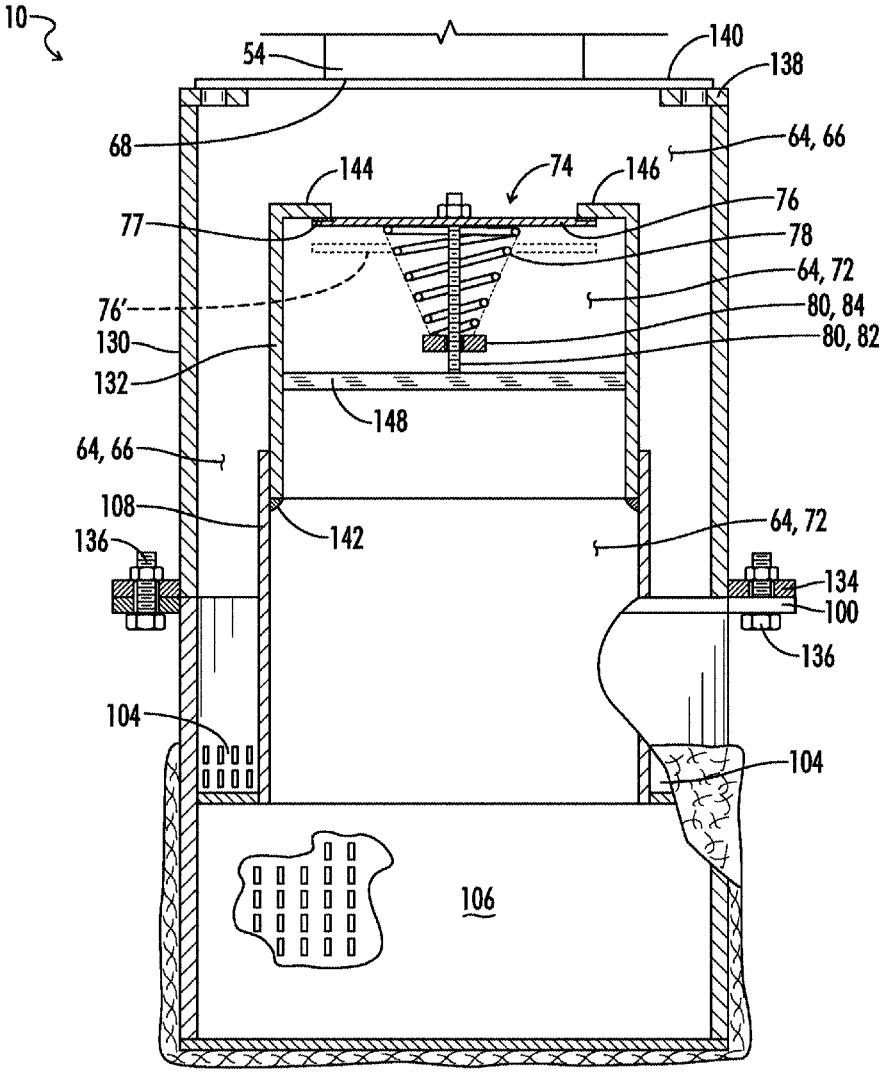
FIG. 6 is a schematic cross-section elevation view of the dual chamber burner of FIG. 5 in combination with a first embodiment of a flow control valve using a disc shaped valve member and a co-axial compression biasing spring.

In one embodiment as illustrated in FIG. 6, the flow control valve 74 includes a disc shaped valve member 76, which may also be referred to as a damper 76, movable between a closed position as shown in solid lines blocking the flow of fuel and air mixture to the second burner chamber 106, and an open position 76' as shown in dashed lines allowing flow of fuel and air mixture to the second burner chamber 106. A biasing spring 78 in the form of a compression spring is arranged coaxial with the disc shaped valve member 76, and biases the valve member 76 toward the closed position. As is further described below, in the closed position the valve member 76 blocks an opening 146 defined in a valve manifold housing 132. The valve member may have a sealing gasket 77 on its upper surface to seal around the opening 146.

Optionally, a spring pre-load adjuster 80 is provided and is configured to adjust an opening force required to move the valve member 76 from the closed position. This adjustment may be used to offset the effects of changes in air density as a result of varying altitudes that may be encountered in the installation of the burner apparatus 10. The opening force may be adjusted by lengthening or shortening the coil compression spring 78 by the threaded makeup of threaded nut 84 on the threaded rod 82 of the spring pre-load adjuster 80.

Figure 7:
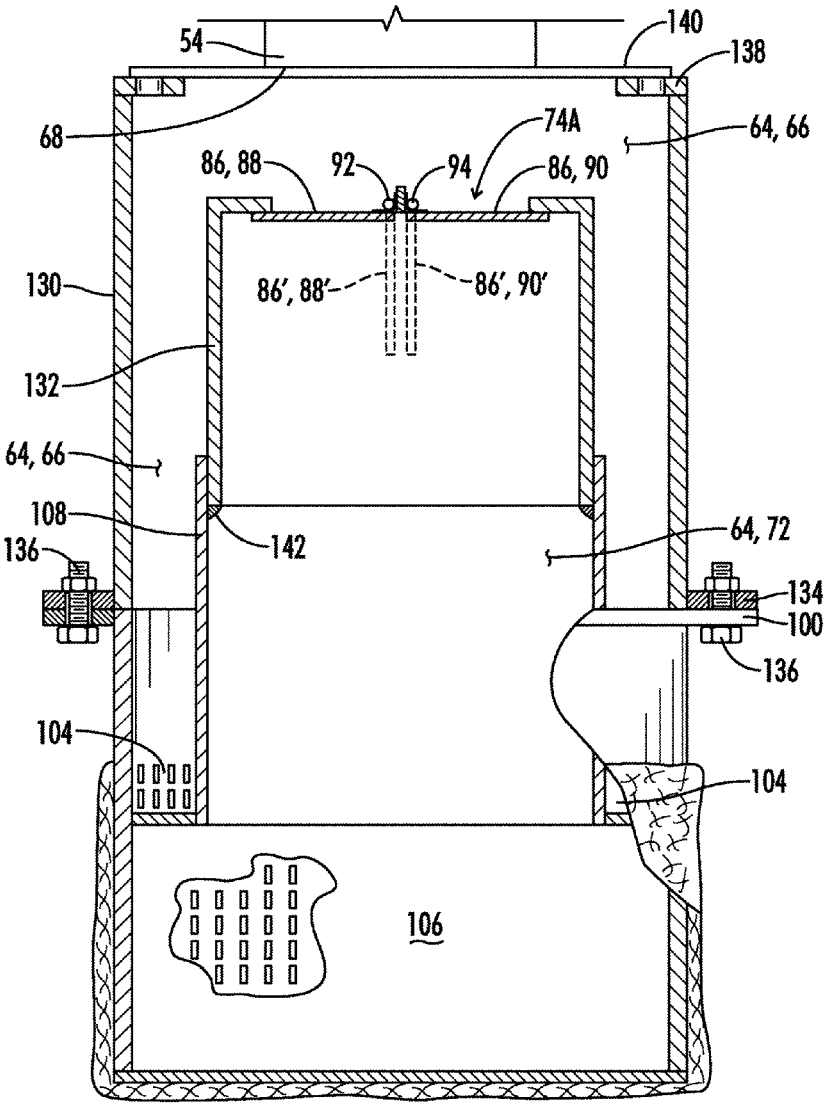
FIG. 7 is a schematic cross-section elevation view of the dual chamber burner of FIG. 5 in combination with a second embodiment of a flow control valve using a multiple flapper valve member with tension biasing springs.

In another embodiment as shown in FIG. 7, an alternative flow control valve 74A includes a valve member 86 having multiple flapper elements 88 and 90, which may also be referred to as damper elements 88 and 90. A plurality of coil tension springs 92 and 94 associated with the valve flapper elements 88 and 90 bias the flapper elements 88 and 90 to their closed positions as shown in solid lines in FIG. 7. As blower speed is increased, increased air pressure from the blower assembly 52 will overcome the biasing force of springs 92 and 94 and move the flapper elements 88 and 90 to their open positions 88' and 90' shown in dashed lines in FIG. 7.

Figure 8:
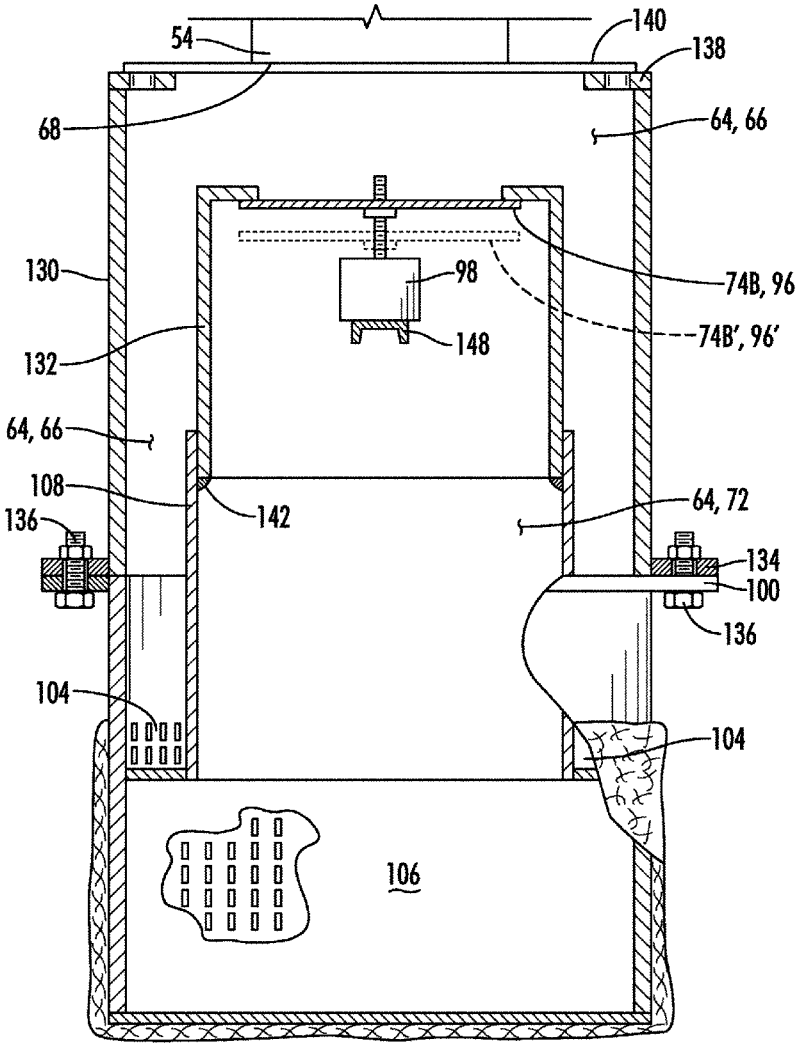
FIG. 8 is a schematic cross-section elevation view of the dual chamber burner of FIG. 5 in combination with a third embodiment of a flow control valve using a positive displacement valve member along with an electric actuator.

In yet another embodiment shown in FIG. 8, a flow control valve 74B is a positive control valve including a valve member 96 and an actuator 98 configured to positively control the position of the valve member 96. The actuator 98 may for example be an electrically driven actuator 98 which rotates a threaded shaft 99 to move the valve member 96 from the closed position shown in solid lines to an open position 96' shown in dashed lines. As shown in FIG. 10 the electric actuator 98 may receive a control signal 218 from controller 200 to control the actuator 98 in response to blower speed of blower 54 as sensed by blower speed sensor 202.

The Burner Assembly

Figure 5:
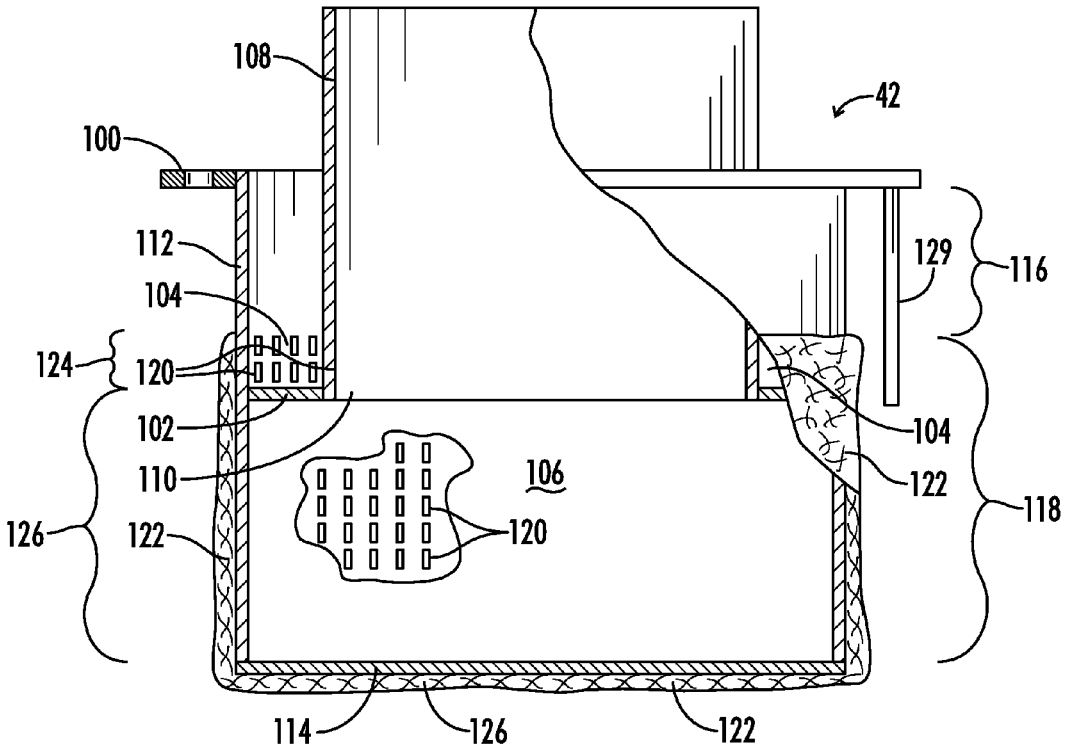
FIG. 5 is a schematic cross-section elevation view of a dual chamber burner.

Referring now to FIG. 5 the details of construction of one embodiment of the burner assembly 42 are best seen. The burner assembly 42 is generally cylindrical in shape and extends into the combustion chamber 32 of the primary heat exchanger section 28. Burner assembly 42 includes a flanged upper end 100 and an interior wall 102 spaced from the upper end 100. The interior wall separates the burner 42 into first and second burner chambers 104 and 106. The burner chambers 104 and 106 may also be referred to as first and second zones or first and second plenums or first and second stages.

The two chamber burner 42 can generally be referred to as a multi-chamber burner 42 including at least a first burner chamber 104 and a second burner chamber 106. The multi-chamber burner 42 may also have more than two chambers. In such a case each additional burner chamber will have an associated flow control valve to bring that burner chamber into operation at a selected blower speed.

A duct 108 extends upward from interior wall 102. Duct 108 is welded or otherwise attached to interior wall 102. The lower end of duct 108 communicates through opening 110 in interior wall 102 with the second burner chamber 106.

The burner apparatus 42 further includes a cylindrical outer burner housing 112 extending from the flange 100 downward to a lower end plate 114. An upper portion 116 of cylindrical outer burner housing 112 is a solid cylindrical non-perforated structure, and a lower portion 118 of the cylindrical outer burner housing 112 includes rows of slotted perforations 120. The bottom plate 114 may also be perforated in a manner similar to the slotted perforations 120. A foraminous outer layer 122 is received about the perforated portion 118 and bottom plate 114. The foraminous outer layer 122 may for example be a ceramic fiber weave material, or it might also be a woven metal fabric, or any other suitable material providing many very small passageways for fuel and air mixture to flow therethrough.

The interior wall 102 divides the foraminous outer layer 122 into a first foraminous burner surface 124 and a second foraminous burner surface 126.

The apparatus 10 preferably utilizes a direct spark ignition element 128 (see FIG. 1) extending downward into the combustion chamber 32 to a location adjacent the exterior of the first foraminous burner surface 124 so that when the operation of the apparatus 10 is first initiated, and premixed fuel and air are flowing only to the first burner chamber 104, the fuel and air mixture exiting the first foraminous burner surface 124 can be ignited by the direct spark ignition element 128 located adjacent thereto.

In the construction illustrated in FIG. 5, the first and second foraminous burner surfaces 124 and 126 are separated only by the thickness of the interior wall 102 and are sufficiently close to each other so that flame from the first foraminous burner surface 124 will subsequently ignite fuel and air mixture exiting the second foraminous burner surface 126. Thus only a single direct spark ignition device 128 is needed.

It will be appreciated that due to the presence of the interior wall 102 there will be a small gap between the exterior burner surfaces 124 and 126 associated with the first chamber 104 and second chamber 106 of the burner assembly 42. When the heating apparatus 10 is first fired up, there will only be flame on the exterior surface 124 of the first burner chamber 104. Hot combustion gases will be flowing downward past the outer surface 126 of second burner chamber 106 and upon opening of control valve 74 those hot gases will ignite fuel being provided to second burner chamber 106. Although the physical gap created by interior wall 102 is preferably kept to a minimum, it will be appreciated that so long as the first foraminous burner surface 124 is sufficiently close to second foraminous burner surface 126 that the gases exiting the second burner chamber 106 can be ignited, then the apparatus 10 can operate with only the single direct spark ignition element 128 initially igniting the flame from first burner chamber 104. Although it is preferred for practical reasons that the burner assembly 42 be an integrally constructed burner assembly, it is conceivable to completely physically separate the burner surfaces associated with the first and second burner chambers 104 and 106 so long as they are feeding a common combustion zone 32 and are sufficiently close that second foraminous burner surface 126 can take ignition from flame from first foraminous burner surface 124, and so long as the design prevents physical damage from occurring to the neighboring burner.

Due to the proximity of the burner surfaces 124 and 126 to each other, and because the same fuel/air mixture exits both burner surfaces, it is also only necessary to have one flame sensor 129 to confirm that flame is present at the burner assembly 42. The second foraminous burner surface 126 does not need a second flame sensor.

Referring now to FIG. 6, the burner assembly 42 as just described with regard to FIG. 5 is shown assembled with a supply manifold housing 130, and a valve housing 132 which define the manifold 64 previously schematically described with reference to FIG. 1. The manifold housing 130 is a cylindrical member having a radially outward extending lower flange 134 which is arranged to be connected to the upper flange 100 of burner housing 112 by bolts 136.

The manifold housing 130 has a radially inward extending upper flange 138 which is arranged to have the blower 54 mounted on top thereof with a blower mounting flange 140.

The valve housing 132 is a cylindrical member telescopingly received within the upper end of duct 108 of burner assembly 42 and attached thereto such as by weld 142. A radially inward extending flange 144 at the upper end of valve housing 132 has an opening 146 defined therein which in FIG. 6 is shown to be closed by engagement of the disc shaped valve member 76 with the lower surface of flange 144.

The support rod 82 of the disc shaped valve element 76 is attached to a cross member 148 extending diametrically across the interior of valve housing 132.

Blower Operation

Figure 9:
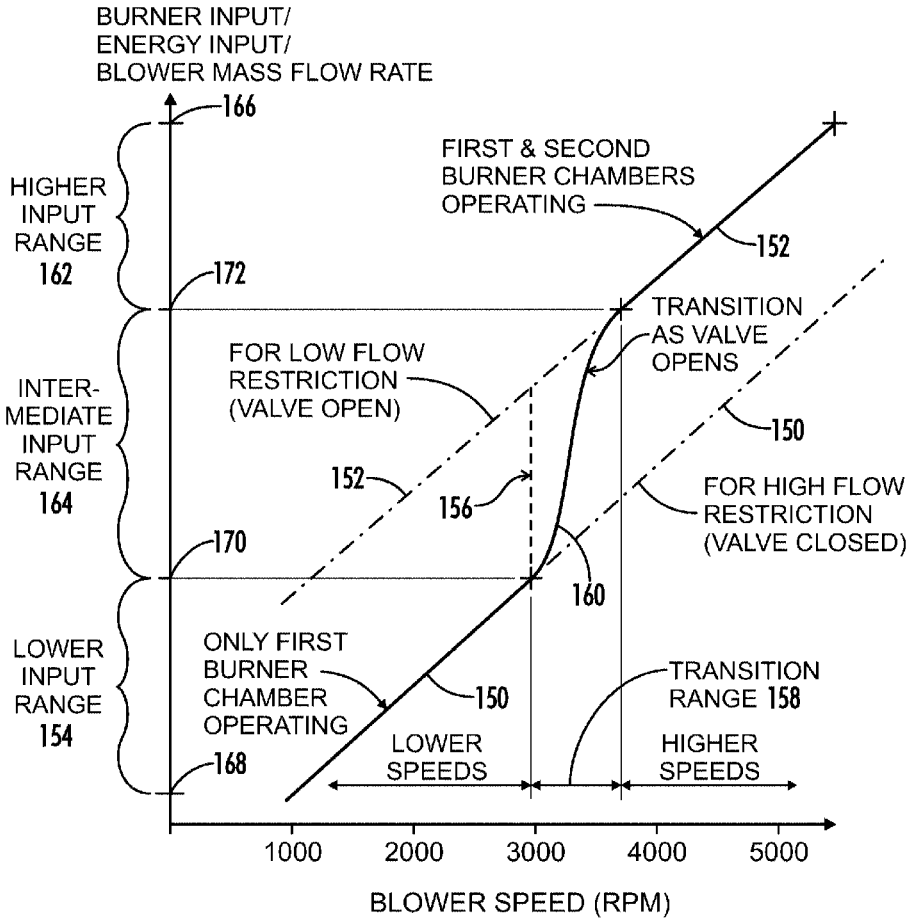
FIG. 9 is a graphic representation of energy input to the burner, which also corresponds to blower output, versus blower speed.

Referring now to FIG. 9, the general manner of operation of the blower assembly 52 in combination with the manifold 64 and flow control valve 74 supplying fuel and air mixture to the two chamber burner 42 will be generally described.

The blower 54 may be a centrifugal blower. As will be understood by those skilled in the art, for any given conditions at the inlet of the blower regarding inlet pressure, inlet temperature, and the makeup of the gases being conveyed by the blower, the blower will have a blower output versus blower speed curve for a given flow restriction downstream of the blower. This blower output may be measured as a mass flow rate, or as a volumetric flow rate, or as a blower outlet pressure, but however measured the blower output will have a shape generally as shown in FIG. 9.

With the system shown in FIG. 1, when the flow control valve 74 is closed and the fuel and air mixture is flowing only to the first burner chamber 104, the first burner stage and particularly the construction of the slots 120 and the first foraminous outer burner surface 124 define a first flow restriction, which for the purposes of this discussion will be referred to as a higher flow restriction. Then, when the control valve 74 opens, fuel and air mixture will flow to both the first burner chamber 104 and the second burner chamber 106, which two burner chambers together will define a lower flow restriction because of the increased area provided for the fuel and air mixture to flow through both the first foraminous burner surface portion 124 and the second foraminous burner portion 126.

Referring to FIG. 9, the phantom line 150 schematically represents a blower output versus blower speed curve for the blower 54 when the control valve 74 is closed and the flow restriction downstream of the blower is defined solely by the first burner chamber 104.

Similarly, curve 152 defines the blower output versus blower speed curve for the blower 54 when the control valve 74 is open and both the first and second burner chambers are operative.

This blower output or flow rate of fuel and air mixture also directly corresponds to the energy input to the burner 42, so the curves of FIG. 9 also represent energy input versus blower speed and burner input versus blower speed.

In the example illustrated in FIG. 9, the control valve 74 is designed to begin opening at a blower speed of approximately 3,000 rpm. Thus at lower blower speeds below 3,000 rpm extending down to the lowest possible operational speed of the blower 54, the first stage chamber can be continuously modulated over a burner input range which is designated as a lower input range 154.

If it were possible to immediately open the control valve 74 and immediately transition to full operation of the first and second burner chambers, the input to the two stage burner 42 would jump from the curve 150 vertically along dashed line 156 to the second curve 152. Such an abrupt jump, however, does not actually occur because it takes some time for the control valve 74 to open and for the blower and the flow rate to respond. Thus during some transition range 158 of blower speeds the actual energy input to the burner apparatus will pass through an intermediate transition curve 160 until the flow rate is fully established through the second burner chamber at which point the blower speed will be in the range indicated on FIG. 9 as the higher speeds, and the burner input will be in the higher input range 162 in which the input is again fully modulatable throughout the higher speed range. As is apparent in FIG. 9, the intermediate transition curve 160 is a non-linear curve and is steeper than the curves 150 or 152.

Thus, as a result of the operation of the control valve 74 there is an intermediate input range 164 in which there is less precise control and a much steeper modulation curve than there is in the lower and upper input ranges 154 and 162.

The system represented in FIG. 9 has an overall modulation range equal to a maximum energy input 166 to the first and second burner chambers operating together at a maximum blower speed, divided by a minimum energy input 168 to the first burner chamber operating alone at a minimum blower speed. This modulation range is preferably at least 16 to 1, and more preferably is at least 25 to 1.

When using the mechanical valve with mechanical biasing spring arrangement of either FIG. 6 or FIG. 7, the biasing spring is configured such that as the blower speed increases through the blower transition speed range 158, pressure from the blower acting on the valve member overcomes the biasing spring to move the valve member to the open position. Thus as this mechanical valve and spring combination moves to its open position there is a decreased modulating control over that transition as compared to the control available in the lower and upper speed ranges. The transition occurs as a function of the spring and valve system design.

On the other hand, if the positive control valve arrangement of FIG. 8, is utilized it is possible that there is some greater control over the transition from curve 150 to 152, which control is related to the control of the opening of the valve. But the burner is still not being modulated in response to increasing blower speed so much as it is in response to control of the opening of valve 74. Thus with regard to the relationship between energy input to the burner and blower speed, this transition still results in a steeper modulation curve 160 during the transition.

The energy input to the burner 42 can be described as being continuously modulated between a first energy input value 168 and a second energy input value 170 corresponding to the lower speed range of the blower 54. The energy input to the burner can also be continuously modulated between a third energy input value 172 and a fourth energy input value 166 corresponding to the higher speed range of the blower. The fourth energy input value 166 divided by the first energy input value 168, as previously noted, defines the overall modulation range of the heater apparatus. The steeper intermediate modulation curve, as previously noted, is defined between the second energy input value 170 and the third energy input value 172, corresponding to a transition of the blower output from the first curve 150 to the second curve 152 as the valve 74 opens.

This steeper modulation curve is the tradeoff that is made to achieve the high turndown ratios of the burner 42 without a complex dual blower system having individual blowers feeding each burner chamber. But a primary advantage of a high turndown ratio, namely high maximum energy input to the burner while maintaining the ability to operate at low minimum levels to avoid cycling the burner on and off, is still achieved, at a greatly reduced cost and reduced complexity. This avoids the off-cycle losses of energy that occur during off periods.

It is noted that during operation of the first burner chamber when blower speed is in the lower speed range, a positive pressure differential exists across the valve 74 from the first passage portion 66 to the third passage portion 72, thereby preventing back flow through the second burner chamber 106.

As described above, in the embodiment disclosed the blower 54 and the burner 42 are continuously modulated within the blower speed ranges of interest. In a broader aspect of the invention, however, the blower speed may be modulated in a non-continuous fashion resulting in a non-continuous modulation of burner input. For example, the blower 54 may be programmed to increase and decrease speed in a step-wise fashion. Also a multi-stage source 52 of pressurized air and fuel mixture may be provided using a series of gas valves that are placed into and out of service to provide a step-wise modulated source of pre-mixed air and fuel. For such a non-continuous modulation the source 52 of pressurized air and fuel mixture would provide a series of input levels of air and fuel mixture, with an appropriate substantially constant air to fuel ratio being maintained at each input level.

Example

The following provides one example of a burner apparatus providing enhanced turndown capabilities using the principles described above. In this example, a total burner size for the area of outer burner surfaces 124 and 126 of chambers 104 and 106 is selected as if the total burner size were for a single chamber burner having a blower without the control valve system 74. The total burner size is selected for a maximum energy input of 400,000 BTU/Hr, and uses a blower having a turndown ratio of 5 to 1.

Based upon the maximum desired energy input of 400,000 BTU/Hr, the total size of the burner is selected and the blower 54 is sized so that at its maximum speed the blower 54 provides appropriate mass flow rate of fuel and air mixture to the burner so as to generate the desired 400,000 BTU/Hr energy input to the burner. Accordingly, when operating at its minimum speed the blower provides appropriate mass flow rate of fuel and air mixture to the burner so as to generate 80,000 BTU/Hr energy input to the burner based on the 5:1 turndown of the blower.

By incorporating the control valve system 74 in the manner described above to the same burner/blower/gas valve arrangement, the burner assembly can be arranged so as to provide a minimum turndown of 25,000 BTU/Hr (turndown ratio of 16:1) by selecting the burner area of the first foraminous burner surface 124. Thus, the position of the interior wall 102 within the cylindrical housing 112 is selected so as to define the proper area for the first foraminous burner surface 124 to achieve the desired 25,000 BTU input at the lowest blower output speed. This will depend upon the inherent characteristics of the foraminous burner surface 124 and the flow rates needed to achieve a stable flame front on the foraminous burner surface 124.

Next, the characteristics of the flow control valve 74 must be designed to allow the valve 74 to open at the desired speed. For example, utilizing the coil compression biasing spring arrangement of FIG. 6, the force acting against the biasing spring due to the output pressure from blower 54 with a blower speed range from 1250 to 5500 RPM acting on the area of the disc shaped valve member 76 can be calculated. This force is calculated for the desired blower speed at which the valve is to begin opening, for example 3,000 rpm as shown in FIG. 9. From this known pressure acting on the disc shaped valve member 76, the necessary biasing force from the spring 78 can be calculated. Thus the spring 78 is designed to begin compressing at the force level acting on the disc shaped valve member 76 from the blower 54 operating at a speed of 3,000 rpm. The spring 78 is also designed to rapidly collapse to the fully open position after it begins opening such that the operation of the two chamber burner 42 quickly transitions to the upper curve 152 along the intermediate transition curve portion 160. Thus at the higher blower speeds after the valve 74 is open, the burner can be continuously modulated up to the maximum blower speed corresponding to the maximum energy input 166.

In this example the chambers 104 and 106 of burner 42 may have an inside diameter of approximately 6.5 inches. The first foraminous burner surface 124 may have an axial length of approximately ⅝ inches and the second foraminous burner surface may have an axial length of 4.25 inches. The opening 146 closed by disc shape valve element 76 may have a diameter of 3.75 inches. The biasing spring 78 may be designed to allow the valve 74 to open at a force of 0.584 pound. The blower 54 may for example be a Model RG 148 available from EBM Pabst. The venturi and gas valve may be a combination venturi/gas valve model VR8615F available from Honeywell. In this example the burner lower end plate 114 is not perforated and the burner end does not have combustion taking place; it is not an active burner end.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are embodied with the scope and spirit of the present invention as defined by the following claims.

What is claimed is:

1. A modulating burner apparatus, comprising:

one and only one source of pressurized pre-mixed fuel and air mixture, the source including at least one variable speed blower;

a multi-chamber burner configured to burn the pre-mixed fuel and air mixture, the burner including at least a first burner chamber and a second burner chamber; and a flow control valve including a valve member movable between a closed position restricting flow of fuel and air mixture to the second burner chamber, and an open position allowing flow of fuel and air mixture to the second burner chamber, the flow control valve further including a biasing spring biasing the valve member toward the closed position, such that fuel and air mixture is permitted to flow from the one and only one source to the first burner chamber at lower blower speeds of the blower and to both the first and second burner chambers at higher blower speeds of the blower, wherein the valve member includes multiple flapper valve elements.

2. The apparatus of claim 1, wherein:

the at least one variable speed blower includes one and only one blower.

3. The apparatus of claim 1, wherein:

the at least one variable speed blower includes multiple blowers supplying a common source, the common source being the one and only one source.

4. The apparatus of claim 1, further comprising:

a spring pre-load adjuster configured to adjust an opening force required to move the valve member from the closed position.

5. The apparatus of claim 1, wherein:

the multi-chamber burner includes an interior wall at least partially separating the first burner chamber and the second burner chamber.

6. The apparatus of claim 1, wherein:

the blower is a centrifugal blower having a blower output versus blower speed curve for a given flow restriction downstream of the blower; and the first burner chamber defines a higher flow restriction and the first and second burner chambers together define a lower flow restriction, so that at the lower blower speeds when fuel and air mixture is provided to only the first burner chamber the blower output follows a first curve corresponding to the higher flow restriction, and at the higher blower speeds when fuel and air mixture is provided to both the first and second burner chambers the blower output follows a second curve corresponding to the lower flow restriction.

7. The apparatus of claim 6, wherein:

an energy input to the burner can be continuously modulated over a lower input range modulation curve corresponding to operation of only the first burner chamber, and the energy input to the burner can be continuously modulated over a higher input range modulation curve corresponding to operation of both the first and second burner chambers together, there being an intermediate modulation curve between the lower and higher input range modulation curves, the intermediate modulation curve being steeper than the lower and higher input range modulation curves.

8. The apparatus of claim 6, wherein:

the apparatus has an overall modulation range equal to a maximum energy input to the first and second burner chambers operating together at a maximum blower speed divided by a minimum energy input to the first burner chamber operating alone at a minimum blower speed, the overall modulation range being at least 16 to 1.

9. The apparatus of claim 8, wherein the overall modulation range is at least 25 to 1.

10. The apparatus of claim 1, further comprising:

a mixing chamber upstream of the blower, the mixing chamber configured to at least partially pre-mix the fuel and air mixture prior to the fuel and air mixture entering an inlet of the blower.

11. The apparatus of claim 1, wherein:

an energy input to the burner can be continuously modulated over a lower input range modulation curve corresponding to operation of only the first burner chamber, and the energy input to the burner can be continuously modulated over a higher input range modulation curve corresponding to operation of both the first and second burner chambers together, there being an intermediate modulation curve between the lower and higher input range modulation curves, the intermediate modulation curve being steeper than the lower and higher input range modulation curves.

12. The apparatus of claim 1, further comprising:

a heat exchanger having a water side and a hot gas side, the burner being arranged so that hot combustion gases from the burner flow through the hot gas side of the heat exchanger to heat water flowing through the water side.

13. The apparatus of claim 12, wherein:

the heat exchanger is a fire tube heat exchanger including a plurality of fire tubes through which the hot combustion gases flow, the fire tubes being surrounded by a water chamber defining the water side of the heat exchanger.

14. The apparatus of claim 1, wherein:

the valve member is oriented to open in a downstream direction to allow flow of the fuel and air mixture in the downstream direction into the second burner chamber at the higher blower speeds.

15. The apparatus of claim 1, wherein:

the multiple flapper valve elements include two flapper valve elements oriented such that both flapper valve elements pivot in a downstream direction from a horizontal orientation in the closed position to a vertical orientation in the open position of the valve member.

16. The apparatus of claim 1, wherein:

the multiple flapper valve elements include two flapper valve elements arranged such that both flapper valve elements pivot in opposite rotational directions as the valve member moves from the closed position to the open position.

17. A method of modulating energy input to a multi-stage burner, the method comprising:

(a) modulating blower speed of a variable speed blower within a lower speed range to modulate energy input to a first stage of the burner within a lower burner input range while a second stage of the burner is inoperative;

(b) opening a valve and flowing fuel and air mixture in a downstream direction past the valve into the second stage of the burner, wherein the valve includes two flapper valve elements, and the opening of the valve includes pivoting both flapper valve elements in the downstream direction in opposite rotational directions; and (c) modulating blower speed of the variable speed blower within a higher speed range to modulate energy input to the combined first and second stages of the burner within a higher burner input range.

18. The method of claim 17, wherein:

in step (b), the two flapper valve elements are a spring biased toward a closed position, and the valve opens as a result of outlet pressure from the blower acting on the two flapper valve elements valve and overcoming the biasing force from the spring.

19. The method of claim 17, wherein:

during step (b), blower speed increases through a transition speed range separating the lower speed range from the higher speed range.

20. The method of claim 17, wherein:

a highest end of the higher burner input range divided by a lowest end of the lower burner input range defines an overall turndown ratio of at least 16 to 1.

21. The method of claim 20, wherein the overall turndown ratio is at least 25 to 1.

22. The method of claim 17, wherein:

in step (a), the blower speed is continuously modulated within the lower speed range; and in step (c), the blower speed is continuously modulated within the higher speed range.

23. The method of claim 17, wherein:

in step (a), the blower speed is non-continuously modulated within the lower speed range; and in step (c), the blower speed is non-continuously modulated within the higher speed range.

24. A modulating burner apparatus, comprising:

a variable speed blower, the blower including a blower outlet;

a multi-chamber burner configured to burn a pre-mixed fuel and air mixture, the burner including at least a first burner chamber and a second burner chamber, the second burner chamber being located adjacent the first burner chamber so that the second burner chamber can be ignited by the first burner chamber;

a supply manifold communicating the blower with the burner, the supply manifold including a first passage portion communicated with the blower outlet, a second passage portion communicating the first passage portion with the first burner chamber, and a third passage portion communicating the first passage portion with the second burner chamber;

a valve between the first passage portion and the third passage portion, the valve being configured such that as the blower speed increases from a lower speed range through a transition speed range to a higher speed range, the valve moves from a closed position when blower-speed is in the lower speed range to an open position when blower speed is in the higher speed range, wherein the valve includes a valve member movable between a closed position and an open position, and a biasing spring biasing the valve member toward the closed position;

wherein the valve member includes multiple flapper elements; and wherein the biasing spring includes at least one tension spring connected to the flapper elements.

25. The apparatus of claim 24, wherein:

the biasing spring is configured such that as the blower speed increases through the transition speed range, pressure from the blower acting on the valve member overcomes the biasing spring to move the valve member to the open position.

26. The apparatus of claim 25, further comprising:

a spring pre-load adjuster configured to adjust an opening force required to open the valve member against the biasing spring.

27. The apparatus of claim 24, wherein:

the blower is a centrifugal blower having a blower output versus blower speed curve for a given flow restriction downstream of the blower outlet; and the first burner chamber defines a higher flow restriction and the first and second burner chambers together define a lower flow restriction, so that when the valve is in the closed position the blower output follows a first curve corresponding to the higher flow restriction, and when the valve is in the open position the blower output follows a second curve corresponding to the lower flow restriction.

28. The apparatus of claim 27, wherein:

an energy input to the burner can be continuously modulated between a first energy input value and a second energy input value corresponding to the lower speed range of the blower;

the energy input to the burner can be continuously modulated between a third energy input value and a fourth energy input value corresponding to the higher speed range of the blower; and the fourth energy input value divided by the first energy input value defines an overall modulation range of the heater apparatus, the overall modulation range being at least 16 to 1.

29. The apparatus of claim 28, wherein the overall modulation range is at least 25 to 1.

30. The apparatus of claim 28, wherein:

as the valve opens the blower output follows an intermediate modulation curve steeper than the first and second curves.

31. The apparatus of claim 24, further comprising:

a mixing chamber upstream of the blower, the mixing chamber configured to at least partially pre-mix the fuel and air mixture prior to the fuel and air mixture entering an inlet of the blower.

32. The apparatus of claim 24, wherein:

during operation of the first burner chamber when blower speed is in the lower speed range, a positive pressure differential exists across the valve from the first passage portion to the third passage portion, thereby preventing backflow through the second burner chamber.

33. An apparatus for heating water, comprising:

a water conduit having an inlet and an outlet;

a heat exchanger having a water side defining a portion of the water conduit;

a pre-mix burner configured to burn a pre-mixed fuel-air mixture, the burner operatively associated with the heat exchanger to heat water in the water side of the heat exchanger, the burner including a first plenum communicated with a first foraminous burner surface, and a second plenum communicated with a second foraminous burner surface, the first and second foraminous burner surfaces being sufficiently close to each other so that flame from the first foraminous burner surface will ignite fuel-air mixture exiting the second foraminous burner surface;

a variable flow blower having a blower outlet communicated with the first and second plenums;

a damper located between the second plenum and the blower outlet, the damper including multiple flapper valve elements; and a biasing spring biasing the damper toward a closed position, the damper being movable toward an open position when fluid pressure from the blower acting on the damper overcomes the biasing spring.

34. The apparatus of claim 33, further comprising:

a spring pre-load adjuster configured to adjust an opening force required to move the damper from the closed position.

35. The apparatus of claim 33, wherein:

the blower is a centrifugal blower having a blower output versus blower speed curve for a given flow restriction downstream of the blower outlet; and the first foraminous burner surface defines a higher flow restriction and the first and second foraminous burner surfaces together define a lower flow restriction, so that when the damper is in the closed position the blower output follows a first curve corresponding to the higher flow restriction, and when the damper is in the open position the blower output follows a second curve corresponding to the lower flow restriction.

36. The apparatus of claim 33, further comprising:

one and only one ignition element adjacent the first foraminous burner surface.

37. The apparatus of claim 33, further comprising:

one and only one flame sensor adjacent the first foraminous burner surface.

38. A modulating burner apparatus, comprising:

one and only one source of pressurized pre-mixed fuel and air mixture, the source including at least one variable speed blower;

a multi-chamber burner configured to burn the pre-mixed fuel and air mixture, the burner including at least a first burner chamber and a second burner chamber; and a flow control valve including a valve member movable between a closed position restricting flow of fuel and air mixture to the second burner chamber and an open position allowing flow of fuel and air mixture to the second burner chamber, the flow control valve being a positive control valve including an actuator configured to positively control the position of the valve member;

a blower speed sensor; and an electronic controller receiving a blower speed signal from the blower speed sensor, the electronic controller configured to control the actuator in response to the blower speed signal.

39. The apparatus of claim 23, wherein:

the multi-chamber burner includes an interior wall at least partially separating the first burner chamber and the second burner chamber.

40. The apparatus of claim 23, wherein:

the actuator is an electrically driven actuator.

* * * * *